US008757126B2

(12) United States Patent
Sullivan, IV

(10) Patent No.: US 8,757,126 B2
(45) Date of Patent: Jun. 24, 2014

(54) NON-RECIPROCATING PISTON ENGINE

(71) Applicant: Jerome L. Sullivan, IV, Orlando, FL (US)

(72) Inventor: Jerome L. Sullivan, IV, Orlando, FL (US)

( * ) Notice: Subject to any disclaimer, the term of this patent is extended or adjusted under 35 U.S.C. 154(b) by 0 days.

(21) Appl. No.: 14/088,376

(22) Filed: Nov. 23, 2013

(65) Prior Publication Data

US 2014/0144405 A1 May 29, 2014

Related U.S. Application Data

(60) Provisional application No. 61/729,575, filed on Nov. 24, 2012.

(51) Int. Cl.
*F02B 75/32* (2006.01)

(52) U.S. Cl.
USPC ..... 123/197.4; 123/197.1

(58) Field of Classification Search
USPC ..... 123/197.1, 197.4
See application file for complete search history.

(56) References Cited

U.S. PATENT DOCUMENTS 632,010 A 8/1899 Gamble
1,609,388 A * 12/1926 Tebaldi ..... 91/186
3,090,366 A * 5/1963 Nagelmann ..... 123/42
4,010,675 A * 3/1977 Lassota ..... 92/54
7,721,687 B1 5/2010 Lockshaw et al.
8,161,924 B1 4/2012 Lockshaw et al.

FOREIGN PATENT DOCUMENTS

DE 507584 A 9/1930
GB 2216600 A * 10/1989
WO 92/16721 A1 10/1992
WO 94/07003 A1 3/1994

* cited by examiner

*Primary Examiner* — Noah Kamen
(74) *Attorney, Agent, or Firm* — John V. Stewart

(57) ABSTRACT

An engine with pistons (7, 8, 67, 68, 69) that follow a circular motion (6) and respective cylinders (11, 15, 77, 78, 79) that follow a counter-circular motion (13, 17) relative to the pistons, such that each piston follows a linear path (S) relative to the respective cylinder, and at least a top surface (8T) of each piston remains within the cylinder throughout engine operation, resulting in a stroke length (S) four times a radius (R) of the circular motion. The pistons may be interconnected by connecting rods (9) without wrist pins, forming a multi-piston assembly (7-8-9, 115) as a single dynamic unit. Intake (110) and exhaust gas passages may go through the crankshaft (20, 20A) and the connecting rod assembly (115) to ports (130, 132) in the tops of the pistons via rotary valves (126, 128) in the connecting rod assembly.

16 Claims, 7 Drawing Sheets

⊕ = Crankshaft axis
◎ = Piston throw axis and center of piston connecting rod
⊘ = Cylinder gear axis
⊗ = Trunnion axis (cylinder throw axis)

⊕ = Crankshaft axis
◎ = Piston throw axis and center of piston connecting rod
⚠ = Cylinder gear axis
⊗ = Trunnion axis (cylinder throw axis)

⊕ = Crankshaft axis

◎ = Piston throw axis and center of piston connecting rod

⊿ = Cylinder gear axis

⊗ = Trunnion axis (cylinder throw axis)

FIG 7
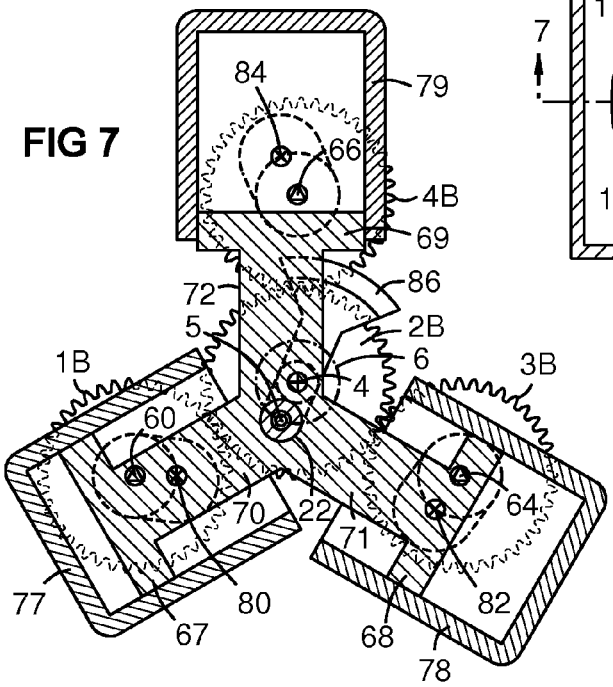
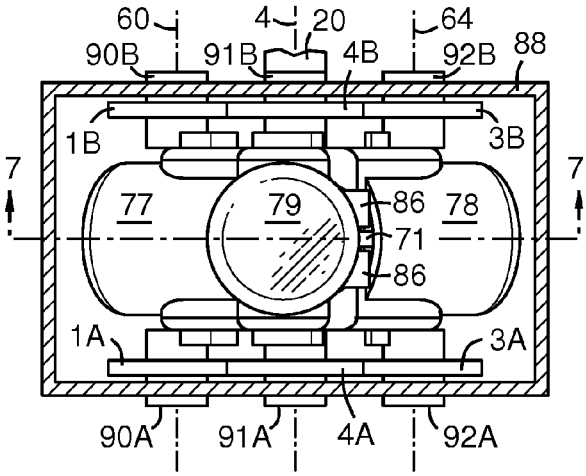
FIG 8
FIG 9
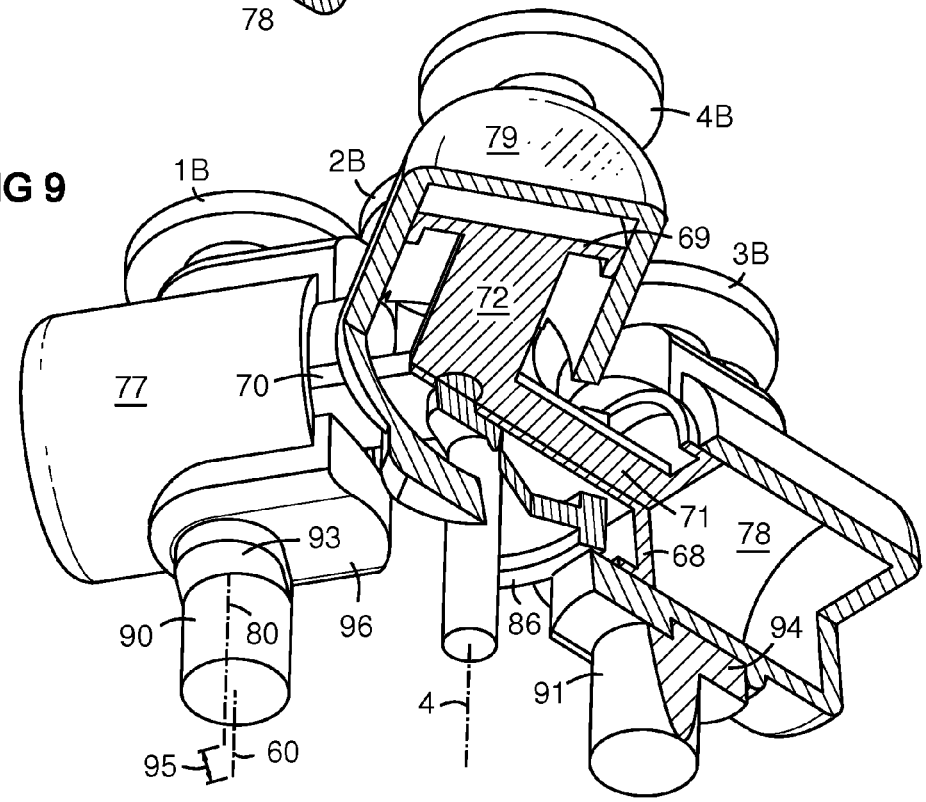

◎ = Piston throw axis and center of piston assembly

NON-RECIPROCATING PISTON ENGINE

This application claims benefit of the Nov. 24, 2012 filing date of U.S. provisional patent application 61729575 which is incorporated by reference herein.

FIELD OF THE INVENTION

This invention relates to piston engines, especially internal combustion engines such as radial engines, rotary piston engines.

BACKGROUND OF THE INVENTION

Conventional piston engines have a rotating crankshaft and stationary cylinder(s). This results in reciprocating pistons that must accelerate from and decelerate to stopped positions, causing vibration, bearing stress, and friction. The connecting rods of the pistons are not aligned with the axes of the cylinders except at the dead center points, resulting in lateral forces causing friction and wear of the piston seal rings and the cylinder inner surfaces. Relative movement between each connecting rod and piston necessitates a pivoting wrist pin connection between them, which ultimately results in an asymmetric velocity curve of the piston about the mid-point of piston travel making any engine with a piston wrist difficult to balance. Many attempts have been made to eliminate at least some of these disadvantages. For example, rotary piston engines have a stationary crankshaft surrounded by a radial array of cylinders that rotate around the crankshaft. This eliminates reciprocating parts, but causes high wind drag loss on the rotating cylinders, and produces strong gyroscopic effects of turning resistance and precession. The Wankel engine replaces pistons with a three-sided eccentric rotor. Gas turbines use rotationally symmetric rotors. Each engine type has unique advantages and disadvantages.

OBJECTS OF THE INVENTION

An object is to eliminate reciprocating parts while retaining the fuel efficiency of cylindrical pistons and cylinders. Another object is to reduce weight constraints on the piston caused by reciprocation forces. Another object is to reduce the radius of crank throws compared to conventional piston engines. Another object is to eliminate misalignment of the piston connecting rods with the respective cylinder axes. A related object is to eliminate wrist pins that pivotally mount the connecting rods to the pistons. Another object is to create a harmonic velocity curve of the piston relative to the cylinder, i.e. to eliminate the asymmetric velocity curve of pistons about the point of mid-stroke inherent in conventional piston engines. Another object is to reduce maximum piston speed relative to the cylinder, but leave the average piston speed relative to the cylinder unchanged when compared to conventional piston engines for a given stroke length and rpm. Another object is to eliminate the dependency of engine performance on the ratio of connecting rod length to crank offset length as in conventional piston engines. Another object is to eliminate the need for a flywheel. These objects are achieved in the engine described and shown herein.

BRIEF DESCRIPTION OF THE DRAWINGS

The invention is explained in the following description in view of the drawings that show:

FIG. 7 is a front sectional view of a 3-cylinder embodiment taken along line 7-7 of FIG. 8, showing three planetary gears engaging a central sun gear.

FIG. 8 is a top view of the engine of FIG. 7, with an engine housing in section.

FIG. 9 is a partly sectioned perspective view of the engine of FIG. 7.

DETAILED DESCRIPTION OF THE INVENTION

Figure 1:
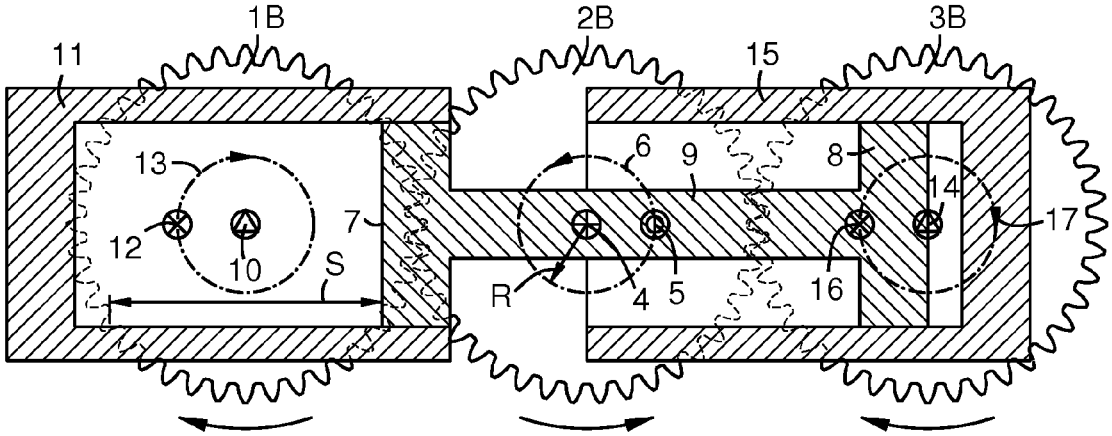
FIG. 1 is a side sectional view of a two-cylinder engine illustrating aspects of an embodiment of the invention.

FIG. 1 is a side sectional view of a two-cylinder engine illustrating aspects of an embodiment of the invention. Three equal spur gears 1B, 2B, 3B are engaged to each other in a linear sequence as shown. The central gear 2B is attached to the crankshaft 20 (FIG. 2), which has a rotation axis 4. The piston throw shaft 22 (FIG. 2) has a throw axis 5, which follows a circular path 6. Two opposed pistons 7 and 8 are interconnected by a connecting rod 9. There is no need for relative motion between the pistons and the connecting rod, so they may form a single dynamic unit, eliminating the conventional wrist pin assembly. The connecting rod is mounted by a bearing at its center onto the piston throw shaft. The first gear 1B has a rotation axis 10. This gear is rotatably connected to the first cylinder 11 by a bearing such as a trunnion 24B (FIG. 2), which has a crank throw axis 12 that follows a second circular path 13. The third gear 3B has a rotation axis 14. This gear is rotatably connected to the second cylinder 15 via a bearing such as a trunnion 26B (FIG. 2), which has a crank throw axis 16 that follows a third circular path 17. The crankshaft 20 and trunnions 24B and 26B are not shown in this view for clarity.

Each point on the pistons and connecting rod follows a respective circular path with the same radius and direction as the piston crank throw path 6. Every point on the cylinders follows a respective circular path with the same radius and direction as the cylinder crank throw paths 13 and 17. The circular path 6 of the piston unit 7, 8, 9 is counter-circular relative to the circular paths 13, 17 of the cylinders 11, 15. This is unlike a conventional piston engine in which the pistons accelerate to and from stopping points at top and bottom dead center positions, which causes stress and friction on the crankshaft bearings. In the invention, the pistons move linearly left and right in a reciprocating motion with respect to the cylinders as a result of their respective circular paths. The pistons never leave the cylinders. For a given effective stroke length, the pistons travel only half as far as in a conventional piston engine, because the cylinders travel as well. The stroke length S is four times the radius R of the piston crank throw (S=4R).

Figure 2:
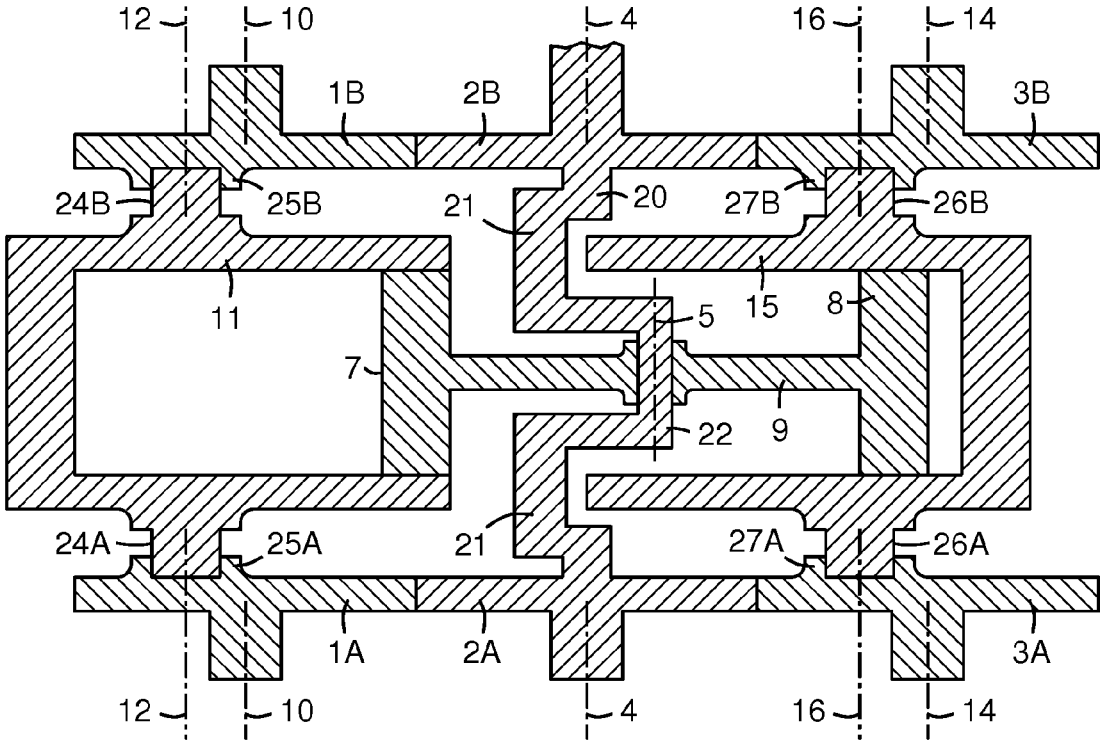
FIG. 2 is a top sectional view of the engine of FIG. 1.

FIG. 2 is a top sectional view of the engine of FIG. 1. The piston crankshaft spans between two spur gears 2A and 2B. The cylinders 7 and 8 are supported between respective pairs of trunnions 24A/24B and 26A/26B via respective trunnion bearings 25A/25B and 27A/27B. These bearings are shown on the gear end of the trunnions in FIG. 2, but they could be on either or both ends. The trunnions may be rotationally fixed to the cylinder or the spur gear, or neither, but not both. The trunnions may be hollow to provide intake and exhaust gas paths to/from the cylinders (not shown). Each trunnion axis 12 and 16 may pass through the center of mass of the respective cylinder 7 and 8. This balances the cylinder about the trunnion axis both statically and dynamically, since each point on the cylinder moves with the same radius and velocity, making the accelerations of all points equal. The crankshaft 20 may provide idle throws 21 opposite the piston throw shaft 22 to allow clearance for the cylinders at the top of the stroke. Counterweights (not shown) on these throws 21 can also help dynamically balance the pistons. The cylinders may be dynamically balanced relative to the respective gear axes 12 and 14 by counterweights on the gears (not shown).

Figure 3:
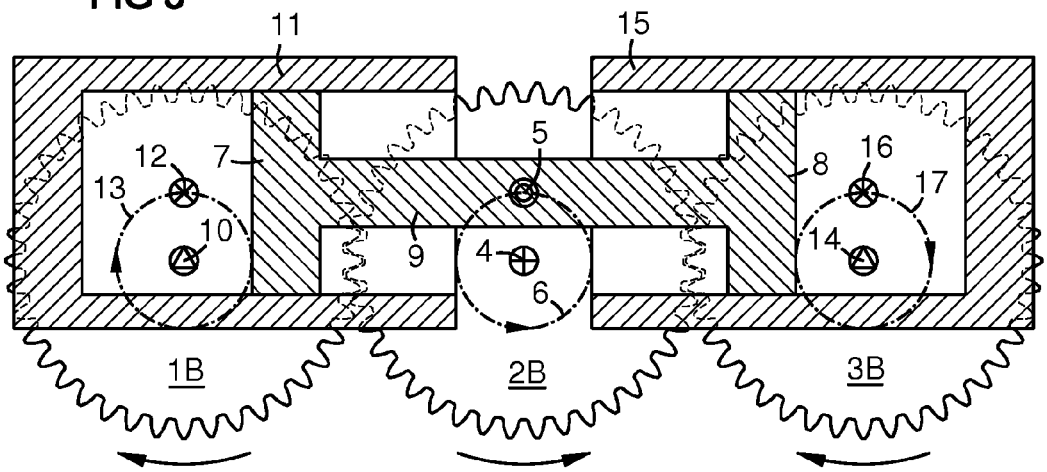
FIG. 3 shows the embodiment of FIG. 1 after 90 degrees of crankshaft rotation.

FIG. 3 shows the embodiment of FIG. 1 after 90 degrees of crankshaft rotation. The trunnion axes 12, 16 and the respective cylinders 11, 15 have moved 90 degrees clockwise around the cylinder gear axes 10, 14. The piston throw axis 5 and the piston unit 7, 8, 9 have moved 90 degrees counterclockwise around the crankshaft axis 4. The pistons 7 and 8 are now at mid-stroke in the cylinders 11 and 15 and their relative speed is at a maximum at this point.

Figure 4:
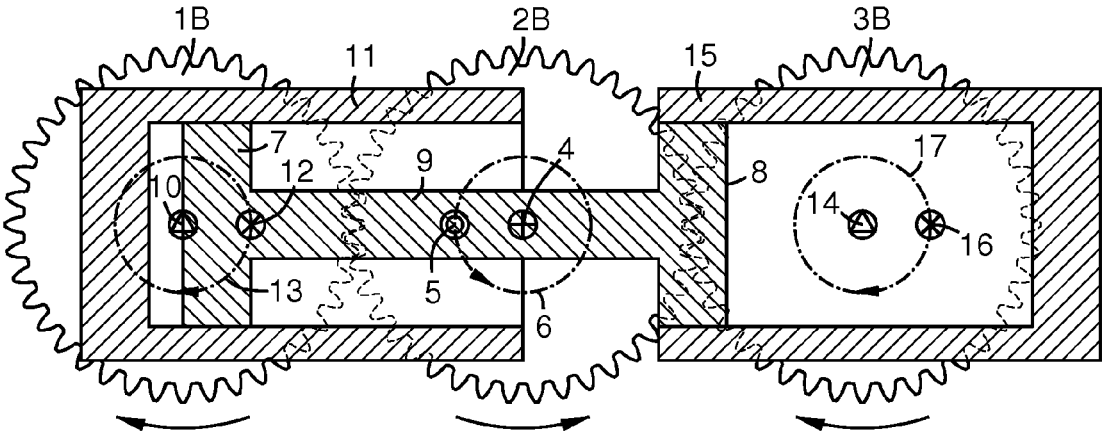
FIG. 4 shows the embodiment of FIG. 1 after 180 degrees of crankshaft rotation.

FIG. 4 shows the embodiment of FIG. 1 after 180 degrees of crankshaft rotation. The trunnion axes 12, 16 and the respective cylinders 11, 15 have moved 180 degrees clockwise around the cylinder gear axes 10, 14. The piston throw axis 5 and the piston unit 7, 8, 9 have moved 180 degrees counterclockwise around the crankshaft axis 4. The left piston 7 is at top of stroke, and the right piston 8 is at bottom of stroke in the cylinders 11 and 15. At this point, the pistons are not stopped as in a conventional piston engine. They are in continuous circular motion.

Figure 5:
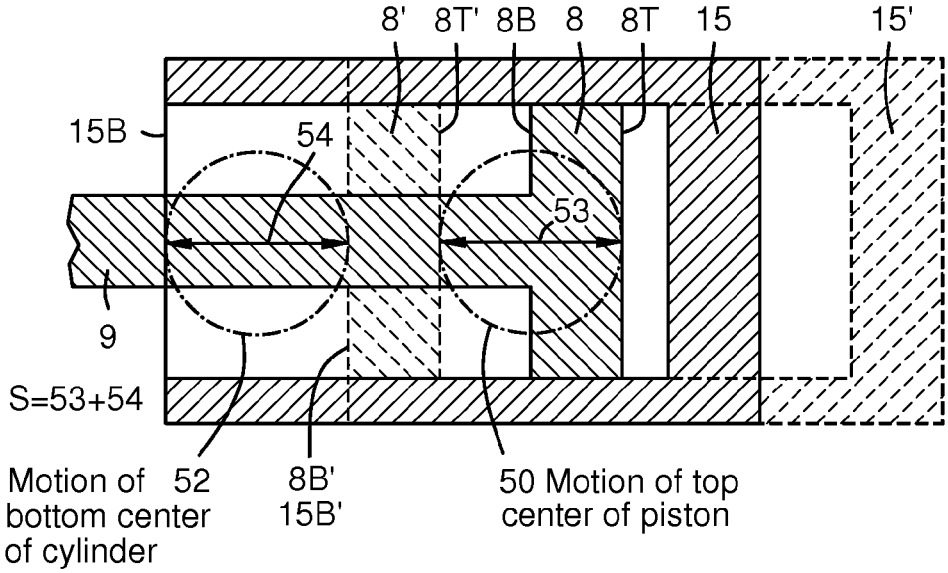
FIG. 5 shows the relative positions of a piston in a cylinder at the top of the stroke (solid lines) and at the bottom of the stroke (dashed lines).

FIG. 5 shows the relative positions of a piston 8 in a cylinder 15 at the top of the stroke (solid lines) and at the bottom of the stroke (dashed lines). The piston 8 at top of stroke has a top surface 8T and a bottom 8B. The cylinder at top of stroke has a bottom surface 15B. The piston 8' at bottom of stroke has a top surface 8T' and a bottom 8B'. The cylinder at bottom of stroke has a bottom surface 15B'. At least the top surface of the piston never leaves the cylinder during engine operation. Comparing the motion 50 of the top center of the piston 8-8' with the motion 52 of the bottom center of the cylinder 15-15', the two circles 50 and 52 do not intersect. Comparing the linear reciprocating motion path 53 of the top of the piston 8-8' relative to the motion 54 of the bottom of the cylinder 15B-15B', the relative motion paths 53, 54 do not overlap. The stroke length S is the sum of the lengths of paths 53 and 54, which is equivalent to the sum of diameters of the circular paths 6 and 17 of FIG. 1, and equals 4 times the radius of the circular motions (S=4R). In FIG. 5, the bottom of the piston 8B' at bottom of stroke is flush with the bottom 15B' of the cylinder, but this is not a requirement. Preferably the bottom 8B of the piston never leaves the cylinder, but this is not a requirement.

Figure 6:
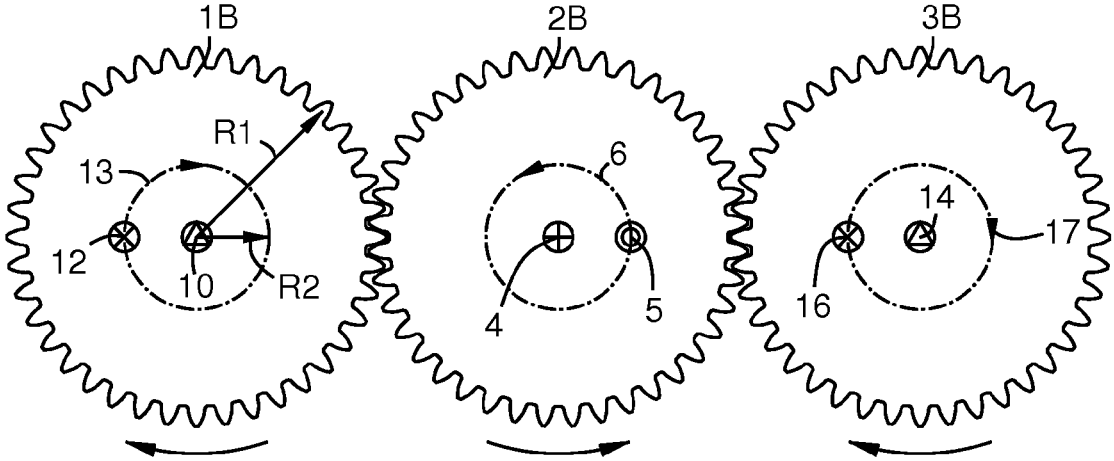
FIG. 6 shows three gears of the engine of FIG. 1 with respective rotation axes and throw axes.

FIG. 6 shows the three back gears 1B, 2B, 3B, with their respective rotation axes 10, 4, 14, and throw axes 12, 5, 16 with respective circular paths thereof 13, 6, 17. The gears 1B, 2B, 3B all have the same first radius R1, and the circular paths 13, 6, 17 all have the same second radius R2 or throw, so that the pistons and cylinders stay in alignment with each other. The first radius R1 or gear size may be determined by clearance requirements for the crankshaft between the bottoms of the opposed cylinders. The second radius R2 or throw may be determined by a desired compression ratio. Larger throws R2 provide a higher compression ratio for a given cylinder length. Larger gears provide more clearance for the crankshaft.

FIG. 7 is a front sectional view of a 3-cylinder embodiment taken along line 7-7 of FIG. 8, showing three planetary gears 1B, 3B, and 4B with respective axes 60, 64, and 66 engaging a central sun gear 2B with axis 4, which is the crank shaft axis. Three pistons 67, 68, 69 are interconnected by three respective connecting rods 70, 71, 72 forming a piston assembly that is bearing-mounted at its center of mass to a crank on the sun gear with a throw axis 5 that is offset from the crank shaft axis 4. There is no need for relative motion between the pistons and the connecting rod, so the piston assembly may by a single part or a single dynamic unit, eliminating the conventional wrist pin assembly. Three cylinders 77, 78, and 79 receive the three pistons 67, 68, 69 respectively. The pistons and respective cylinders are continually aligned with each other, and are angularly spaced 120 degrees apart. Each cylinder may be mounted on a crank on the respective planetary gear via a bearing such as a trunnion with a respective throw axis 80, 82, and 84 that is offset from the respective planetary gear axes 60, 64, and 66. Piston assembly counterweight 86 may be attached to the crankshaft. It may have a mass at a larger radius from the crankshaft than the piston assembly offset axis 5. This allows the counterweight to have less mass than the piston assembly. All of the crank offsets 5, 80, 82, and 84 may be equal, keeping the pistons and cylinders continually aligned with each other. The piston assembly follows a counter-circular motion with respect to the cylinders while moving each piston in a linear reciprocating motion relative to each respective cylinder.

FIG. 8 shows a top view of the engine of FIG. 7, with a housing 88 in section. Optional front planetary gears 1A, 3A, and 4A are shown.

FIG. 9 is a partly sectioned perspective view of the engine of FIG. 7. The back planetary gears 1B, 3B, and 5B, and the central sun gear 2B are shown symbolically as discs. Front gears as in FIG. 8 are not shown for clarity. Front planetary gears 1A, 1B as shown in FIG. 8 may be attached to respective cylinder gear shafts, which are in turn connected to the cylinders 77, 78 by respective bearings 93, 94 such as trunnions with a respective cylinder throw offset 95. Cylinder counterweights 96 may be provided as needed to center the mass of each cylinder about the cylinder throw axis 80, 82, 84 (FIG. 7). Cylinder rotation counterweights (not shown) may be added to each planetary gear or shaft thereof 90, 91.

In any embodiment, cooling and lubrication may be provided by an oil spray and/or air cooling inside the housing 88 and an oil cooling radiator (not shown). Intake and exhaust gases can be routed/from to the cylinders through the gear shafts 90A, 91A, 92A and/or 90B, 91B, 92B through hollow rotary unions between the gear shafts and the housing 88 and hollow rotary unions between the trunnions and the cylinders to reach gas channels in or on the cylinder walls to the top of the cylinders (not shown). Alternately, gas pipes attached to each cylinder can be provided with rotary unions connected to stationary intake and exhaust manifolds. Such rotary unions have the same small rotation radius no matter where they are located, whether near the bottom or top of the cylinder, since the cylinders do not rotate about the crankshaft, but only move in small circles about the respective cylinder gear (See the cylinder rotation circles 13 and 17 of FIG. 1). Ignition can be provided by conductors routed through the cylinder crank throw shafts via brushes and routed to a spark plug in the top center of each cylinder (not shown). Alternately, an ignition coil such as a planar Tesla coil can be provided on the top or side of each cylinder and energized wirelessly by induction with tuned proximity timing and/or control timing (not shown).

Figure 10:
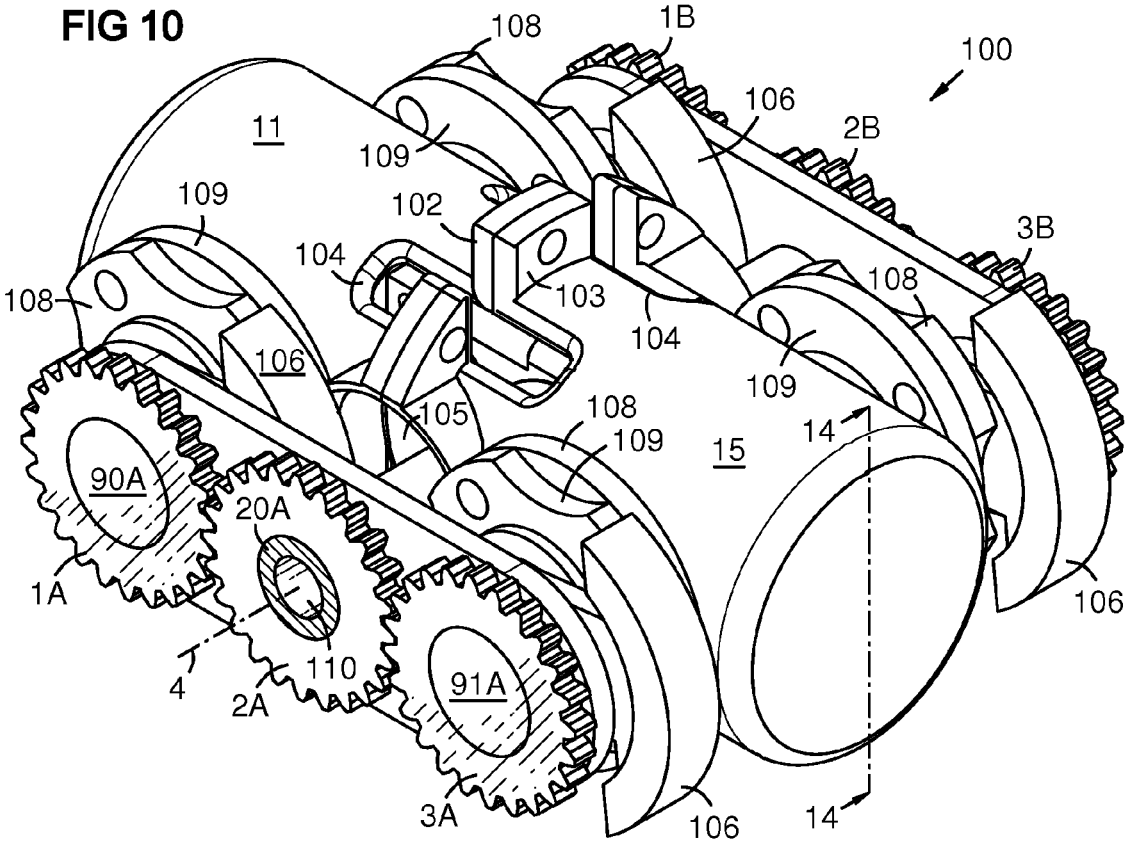
FIG. 10 is a perspective view of an opposed 2-cylinder embodiment.

FIG. 10 shows an opposed 2-cylinder, 4-stroke embodiment 100 with first and second opposed cylinders 11, 15, releasably connected to each other by means such as mating bolt flanges 102, 103 (shown without bolts). Gaps 104 may be provided in the proximal ends of the cylinders for piston counterweight rotation clearance inside the cylinders as later shown. This also provides oil access in addition to openings 105 around the crankshaft for cylinder rotation clearance. Cylinder counterweights 106 may be provided on the gear shafts 90A, 91A. The cylinder crank throw bearings may be releasably attached to the cylinders by means such as mating bolt flanges 108, 109 (shown without bolts). The releasable attachments 102, 103, 108, 109 allow the cylinders to be slidably assembled over the pistons after the rest of the engine is assembled. The two cylinders may be the same part as rotated 180 degrees. The crankshaft 20A is hollow, having an intake channel 110 on one side of the engine, and an exhaust channel on the opposite side. This routes the intake and exhaust gases to and from the cylinders through the connecting rod subassembly as next shown.

Figure 11:
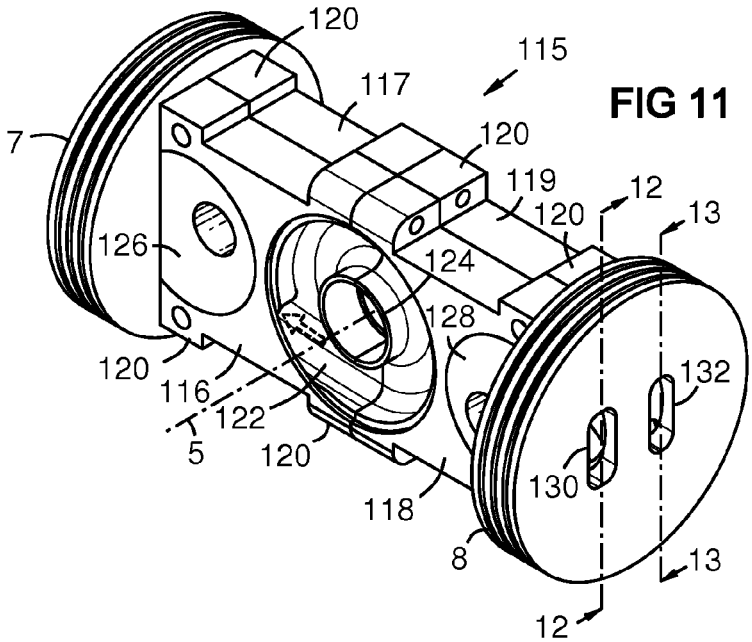
FIG. 11 is a perspective view of a piston assembly for the embodiment of FIG. 10.

FIG. 11 shows a piston assembly 115 for the embodiment of FIG. 10. The connecting rod subassembly 116, 117, 118, 119 contains the intake and exhaust passages and valves. The connecting rod subassembly is fixed with respect to the pistons 7, 8, and is thus always aligned with the cylinders. This allows it to be large enough to almost fill the cylinders. In the example shown there is room for piston assembly counterweights inside the cylinders. The connecting rod assembly may include four main quarters 116, 117, 118, 119, which are releasably attached together such as by bolt bosses 120 (bolts not shown). Quarters 116 and 118 are intake elements. They form an intake plenum 122 around the piston crank throw bearing 124. Premixed fuel/air enters this plenum through the hollow crankshaft 20A (FIG. 10), and leaves the plenum per the dashed arrow toward the valve drum 126. Likewise in the other direction (not visible) toward valve drum 128. The intake quarters 116 and 118 may be two units of the same part as rotated 180 degrees about the piston crank throw axis 5. The valve drums 126, 128 are driven via a gear on the piston throw shaft as later shown. They open an intake port 130 and exhaust port 132 in each piston 7 and 8 at the appropriate times.

Figure 12:
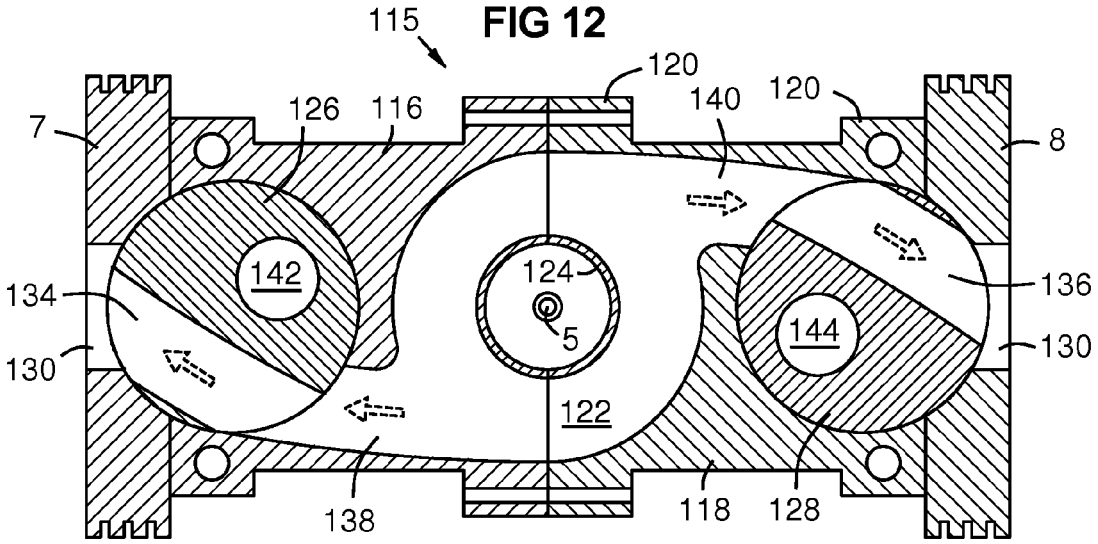
FIG. 12 is a sectional view of the piston assembly taken on line 12-12 of FIG. 11.

FIG. 12 is a sectional view of the piston assembly of FIG. 11 taken on line 14-14 of FIG. 12, showing the intake channels through the piston assembly 115. Two opposed pistons 7 and 8 are interconnected by connecting rod quarters 116 and 118 having an intake plenum 122 around the piston throw bearing 124. Two drum valves 126, 128 are rotated to align respective intake valve channels 134, 136 with respective intake passages 138, 140 in the connecting rod quarters 116, 118, opening the intake ports 130. Optional weight reduction and valve drum balancing holes 142, 144 are shown.

Figure 13:
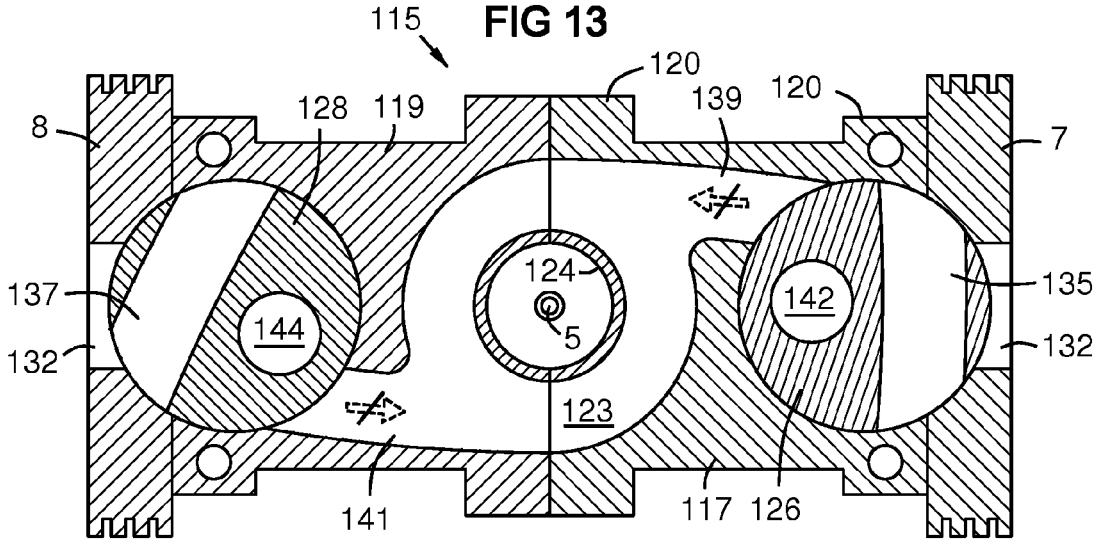
FIG. 13 is a sectional view of the piston assembly taken on line 13-13 of FIG. 11.

FIG. 13 is a sectional view of the piston assembly of FIG. 11 taken on line 15-15 of FIG. 13, showing the exhaust channels through the piston assembly 115. Two opposed pistons 7 and 8 are interconnected by connecting rod quarters 117 and 119 having an exhaust plenum 123 around the piston throw bearing 124. Two drum valves 126, 128 are rotated to misalign the respective exhaust valve channels 135, 137 with the respective exhaust passages 139, 141 in the connecting rod quarters 117, 119, closing the exhaust ports 132 for combustion. Optional weight reduction and valve drum balancing holes 142, 144 are shown. The positions of the drum valves 126, 128 in FIGS. 15 and 16 are shown during the intake cycle.

Figure 14:
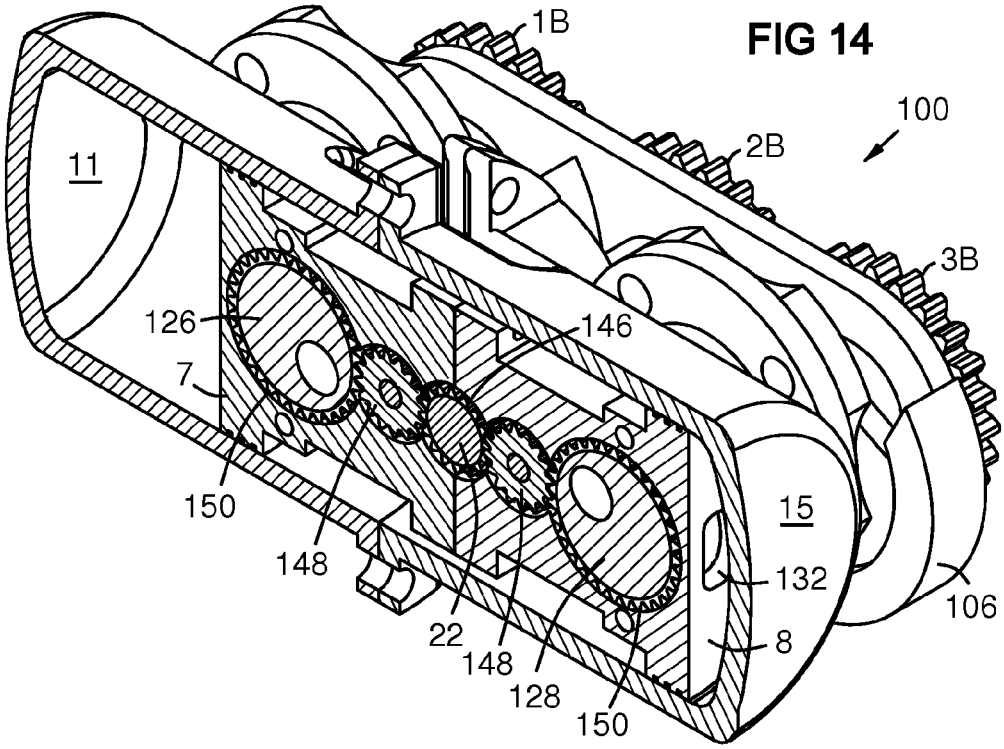
FIG. 14 is a vertical section taken on line 14-14 of FIG. 10.

FIG. 14 is a vertical section through the middle of the engine of FIG. 10 with the second piston 8 at top center position. A valve drive gear 146 is mounted on the cylinder crank throw shaft 22. Intermediate passive gears 148 transmit rotation to gears 150 on the drums 126, 128.

Figure 15:
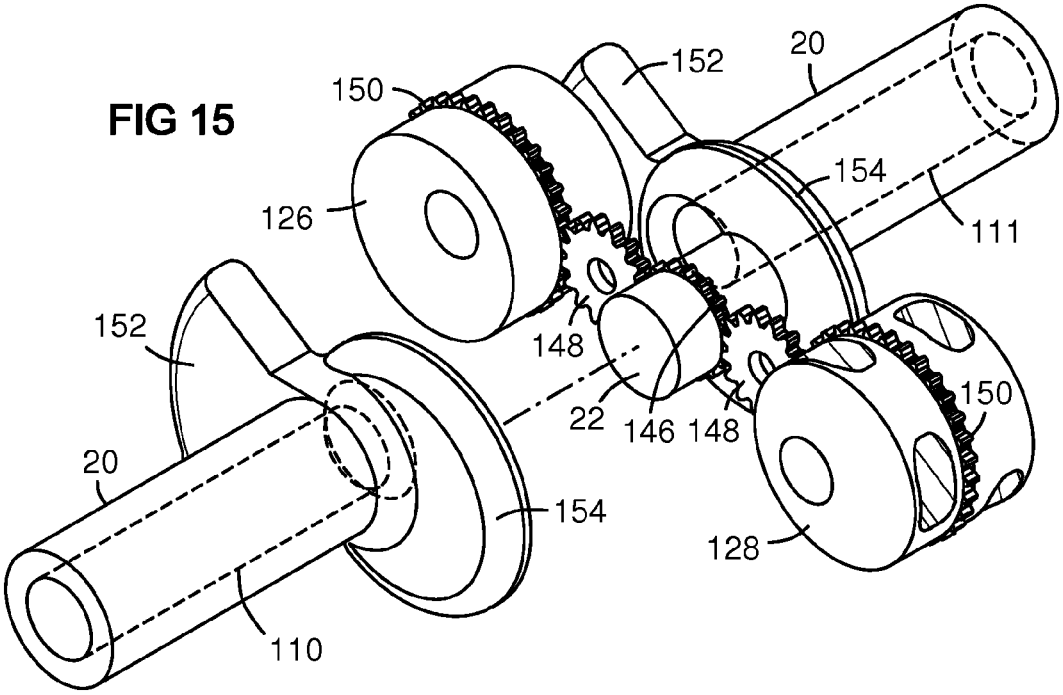
FIG. 15 is a partly exploded view of a drive train for the valve drums.

FIG. 15 is a partly exploded view of the drive train for the valve drums, showing a drive gear 146 on the piston throw shaft 22, two intermediate passive gears 148, and a driven gear 150 on each drum 126, 128. Premixed intake gases enter through a first channel 110 in the crankshaft 20. Exhaust gases exits through a second channel 111 in the crankshaft. Counterweights 152 for the piston assembly are attached to the crankshaft, and may fit inside the proximal ends of the cylinders in this embodiment. Lobes 154 around the piston crank throw shaft 22 seal the intake and exhaust 122, 123 plenums in the connecting rod subassembly.

As an alternative to the shown valve embodiment, electrically actuated rotary or poppet valves in the cylinders and/or the pistons may be powered via conductors connected through brushes in the piston crank throw shaft 22 for valves in the pistons, or through brushes in the cylinder crank throw shafts 24A, 24B, 26A, 26B.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A piston engine comprising;

first, second, and third planetary gears and a central sun gear that engages the three planetary gears;

first, second, and third cylinders, wherein first, second, and third crank throw bearings mount the first, second, and third cylinders to the respective first, second, and third planetary gears in a radial engine configuration, each crank throw bearing comprising a respective first, second, and third crank throw axis that is parallel to and offset from a rotation axis of the respective planetary gear, causing the cylinders to follow a second circular motion;

first, second, and third pistons, wherein the three pistons are fixed in radially outward-facing positions on three interconnected connecting rods that are radially oriented in the same plane, the pistons and connecting rods form a piston unit, at least a top surface of each piston remains within a respective cylinder at all times during operation of the engine; and a fourth crank throw bearing that mounts the piston unit to the sun gear on a fourth crank throw axis that is offset from a rotation axis of the sun gear, causing the pistons to follow a first circular motion;

wherein the second circular motion is in a courter-circular direction from the first circular motion, and each piston follows a linear motion relative to the respective cylinder.

2. The piston engine of claim 1, wherein the fourth crank throw axis passes through the center of mass of the piston unit.

3. The piston engine of claim 1, wherein each respective first, second, and third crank throw axis passes through the center of mass of the respective first, second, and third cylinders.

4. The piston engine of claim 1, wherein a stroke length of the linear motion of the first piston relative to the cylinder is four times the radius of the piston circular motion.

5. A piston engine comprising;

a crankshaft;

a plurality of cylinders;

a sun gear on the crankshaft that engages a respective planetary gear for each respective one of the cylinders;

a piston assembly comprising a plurality of pistons, the piston assembly mounted to the crankshaft by a piston crank throw bearing having a piston crank throw axis that is offset from an axis of rotation of the crankshaft, causing the piston assembly to follow a first circular motion;

each respective cylinder mounted to the respective planetary gear by a cylinder crank throw bearing having a cylinder crank throw axis that is offset from an axis of rotation of the respective planetary gear, causing each cylinder to follow a second circular motion in a counter-rotating direction relative to the piston assembly;

wherein a to surface of each piston remains slidably within each respective cylinder at all times during operation of the engine, and a stroke length of each piston relative to the respective cylinder is four times a radius of the first circular motion.

6. The piston engine of claim 5, wherein the plurality of cylinders comprises two opposed cylinders attached to each other at proximal ends thereof.

7. The piston engine of claim 6, further comprising two counterweights for the piston assembly attached to the crankshaft inside the proximal ends of the cylinders for rotation with the crankshaft.

8. The piston engine of claim 5, wherein the plurality of cylinders comprises two opposed cylinders attached to each other at proximal ends of the cylinders.

9. The piston engine of claim 5, wherein each cylinder crank throw axis passes through the center of mass of the respective cylinder.

10. The piston engine of claim 5, wherein each cylinder is mounted between first and second cylinder crank throw bearings on opposite sides of the cylinder.

11. A piston engine comprising:

a crankshaft comprising an intake gas flow channel and an exhaust gas flow channel;

a piston assembly comprising a plurality of pistons and a connecting rod subassembly connecting the pistons to each other;

the connecting rod assembly mounted to the crankshaft on a piston assembly crank throw bearing that causes the piston assembly to follow a first circular motion;

an intake gas flow path from the intake gas flow channel through the connecting rod subassembly to an intake port in the top surface of each piston;

an exhaust gas flow path from the exhaust gas flow channel through the connecting rod subassembly to an exhaust port in the top surface of each piston;

a plurality of cylinders, each cylinder mounted on a respective cylinder crank throw bearing geared to the crankshaft to follow second circular motion in a counter-rotating direction relative to the piston assembly;

wherein a to surface of each piston remains slidably within a respective one of the cylinders at all times during operation of the engine, and a stroke length of each piston relative to the respective cylinder is four times a radius of the first circular motion.

12. The piston engine of claim 11, further comprising an intake valve and an exhaust valve in the connecting rod subassembly for each of the pistons.

13. The piston engine of claim 12, wherein the piston assembly is mounted by the piston crank throw bearing onto a piston crank throw shaft on the crankshaft, wherein the valves are driven by a gear on the piston crank throw shaft.

14. The piston engine of claim 11, further comprising:

a valve drum in the connecting rod assembly for each piston;

an intake valve channel and an exhaust valve channel in each valve drum; and a gear on each valve drum driven via a gear on a crank throw shaft;

wherein the intake and exhaust channels in each valve drum are aligned and misaligned with respective intake and exhaust gas flow paths in the connecting rod subassembly at predetermined positions between each piston and the respective cylinder.

15. A piston engine comprising;

first, second, and third spur gears engaged with each other in a linear sequence, the second gear being between the first and third gears and counter-rotating relative to the first and third gears;

a first cylinder;

a second cylinder opposed to the first cylinder;

a first piston in the first cylinder;

a second piston in the second cylinder;

a connecting rod that interconnects the first and second pistons in fixed relation to each other, forming a piston unit;

a first crank bearing that mounts the first cylinder to the first gear on a first crank throw axis that is offset from a rotation axis of the first gear, causing the first cylinder to follow a second circular motion;

a second crank bearing that mounts the connecting rod to the second gear on a second crank throw axis that is offset from a rotation axis of the second gear, causing the pistons to follow a first circular motion; and a third crank bearing that mounts the second cylinder to the third gear on a third crank throw axis that is offset from a rotation axis of the third gear, causing the second cylinder to follow the second circular motion;

wherein the second circular motion is in a counter-rotating direction relative to the first circular motion;

wherein the pistons follow a linear motion relative to the cylinders, and at least a top surface of each piston remains in a respective one of the cylinders at all times during operation of the engine; and wherein the first and third crank throw axes pass through respective centers of mass of the first and second cylinders.

16. The piston engine of claim 15 further comprising;

fourth, fifth, and sixth spur gears engaged with each other in a second linear sequence on an opposite side of the cylinders from the first, second, and third spur gears respectively, the fifth gear being between the fourth and sixth gears and counter-rotating relative to the fourth and sixth gears;

The fifth gear connected to the second gear by a crankshaft for co-rotation with the second gear;

a fourth crank bearing on an opposite side of the first cylinder from the first crank bearing, the fourth crank bearing mounting the first cylinder to the fourth spur gear on the first crank throw axis;

a fifth crank bearing on an opposite side of the second cylinder from the third crank bearing, the fifth crank bearing mounting the second cylinder to the sixth spur gear on the third crank throw axis.

* * * * *